United States Patent [19]

Saito et al.

[11] Patent Number: 4,704,196

[45] Date of Patent: Nov. 3, 1987

[54] PROCESS FOR SURFACE TREATMENT OF CARBON FIBER

[75] Inventors: Makoto Saito, Oimachi; Hiroshi Inoue, Miyoshimachi; Noboru Yamamoto, Tokyo, all of Japan

[73] Assignee: Toa Nenryo Kogyo Kabushiki Kaisha, Tokyo, Japan

[21] Appl. No.: 932,770

[22] Filed: Nov. 17, 1986

[51] Int. Cl.[4] ..... C25F 5/00

[52] U.S. Cl. ..... 204/130; 204/28; 204/DIG. 8; 204/DIG. 9

[58] Field of Search ..... 204/DIG. 8–DIG. 9, 204/28, 130

[56] References Cited

U.S. PATENT DOCUMENTS 2,951,025 8/1960 Mostovych et al. ..... 204/28
3,671,411 6/1972 Ray et al. ..... 204/130
4,234,398 11/1980 Yamamoto ..... 204/130
4,401,533 8/1983 Saito et al. ..... 204/130

*Primary Examiner*—R. L. Andrews
*Attorney, Agent, or Firm*—Seidel, Gonda, Goldhammer & Abbott

[57] ABSTRACT

A process for the surface treatment of carbon fiber tows each consisting of a multiplicity of filaments, comprises treating the tows by electrolytic oxidation, using each tow as a positive electrode and applying an electric current in the form of pulses. The pulse spacing is such that the electric supply and non-supply durations are 0.02–20 sec. each, preferably 0.1–5 seconds each. The pulse shape is rectangular, triangular, or sine waves. The applied voltage is 3–15 V and the current density 0.2–1000 A/m$^2$, preferably 1–100 A/m$^2$, more preferably 5–20 A/m$^2$. The electrolyte is an aqueous solution of an oxidizing agent, strong acid or base, neutral salt, or weak acid or base.

10 Claims, 1 Drawing Figure

PROCESS FOR SURFACE TREATMENT OF CARBON FIBER

BACKGROUND OF THE INVENTION

This invention relates, in general, to the manufacture of carbon fiber-reinforced composite materials. More particularly, it pertains to a process for the surface treatment of carbon fiber by electrolytic oxidation so as to improve the adhesion of the fiber to a matrix in the manufacture of carbon fiber-reinforced composite materials. The invention is effectively applicable to the surface treatment of carbon fibers made of not only polyacrylonitrile (PAN) and pitchy materials but also other materials as precursors.

In recent years there has been a growing demand for composite materials reinforced with carbon fiber and which exhibit great strength. One of the most important considerations in the manufacture is improved adhesion between the matrix material and the carbon fiber. The adhesion is known to be strikingly improved by an oxidation treatment of the carbon fiber surface, and various ways of surface treatment have hitherto been suggested.

The present invention is concerned, in particular, with a process for the surface treatment of carbon fiber based on the so-called electrolytic oxidation process that involves anodic oxidation of the carbon fiber by continuous supply of a direct current to the fiber as the positive electrode.

For the electrolytic oxidation, applying a uniform surface treatment to the carbon fiber being fed is essential. To attain this end, for example, U.S. Pat. No. 4,234,398 teaches varying the relative distance between the running filaments and the cathode plate in an electrolytic cell so as to keep the density of current passing across the fiber surface constant throughout the length of the fiber. In the case of Japanese Patent Application Public Disclosure No. 132126/1983, uniform electrolysis is aimed at by flowing an electrolyte countercurrently over moving filaments and thereby preventing the deposition of evolving gas upon the filament surface.

These processes have been found ineffective, however, when a carbon fiber tow comprising a number of filaments is to be treated for electrolytic oxidation. Our investigations in this connection have revealed that, with tows consisting of from 1,000 to 24,000 filaments, for example, the progress of oxidation differs between the central portion and the peripheral portion of each tow. The oxidation progresses little in the center but to excess peripherally. Consequently, the filaments in the center of the tow are not sufficiently surface treated. When such a carbon fiber tow is used in the manufacture of a carbon fiber-reinforced composite material, there is no appreciable improvement in the interlaminar shear strength (hereinafter called ILSS for brevity) of the resulting composite material.

It has also been found that the peripheral filaments achieve an adequate ILSS but, at the same time, reduce the strength of the product. This is particularly true with the treatment of tows made up of 10,000 or more filaments.

The above phenomena may be explained as follows. In the electrolytic oxidation, $OH^-$ ions in the electrolyte release electrons at the positive electrode and the oxidation is carried out with the nescent oxygen formed together with water. When a carbon fiber in the form of multi-filament tow is oxidized, it is presumed that the $OH^-$ ions are mostly consumed by the release of electrons to the outer filaments before they reach the center of the tow, and only a minor part of the $OH^-$ ions that have passed out of contact with the outer filaments contribute to the oxidation of the central portion. Hence, uniform surface treatment is impossible, and difficulties are involved in the choice of conditions that would avoid extreme loss of strength while securing ILSS to some extent.

Therefore, it is a principal object of the present invention to provide a process for the surface treatment of carbon fiber through electrolytic oxidation whereby the fiber can be uniformly surface treated.

Another object of the invention is to provide a process for the surface treatment of carbon fiber through electrolytic oxidation whereby uniformity in the degree of surface oxidation is ensured to both the central and peripheral portions of a carbon fiber tow consisting of a number of filaments by adequate supply of $OH^-$ ions to the center of the tow.

Still another object of the invention is to provide a process for the surface treatment of carbon fiber through electrolytic oxidation which can be practiced with ease making use of existing equipment.

Yet another object of the invention is to provide a process for the surface treatment of carbon fiber through electrolytic oxidation whereby a number of carbon fiber tows can be continuously surface treated to attain constant quality.

A further object of the invention is to provide a process for the surface treatment of carbon fiber through electrolytic oxidation whereby the carbon fiber is obtained for the manufacture of high-strength carbon fiber-reinforced composite materials.

SUMMARY OF THE INVENTION

After extensive studies and experiments on ways of solving the afore-described problems associated with the conventional treatments by electrolytic oxidation, we have found that those problems can be settled by intermittently supplying electricity to carbon fiber filaments running through an electrolytic cell. The present invention is based upon this new concept.

Briefly, the invention resides in a process for the surface treatment of carbon fiber characterized in that, in carrying out electrolytic oxidation of carbon fiber tows each consisting of a multiplicity of filaments and serving as a positive electrode in the presence of an electrolyte, an electric current is applied in the form of pulses.

DETAILED DESCRIPTION OF THE INVENTION

Figure 1:
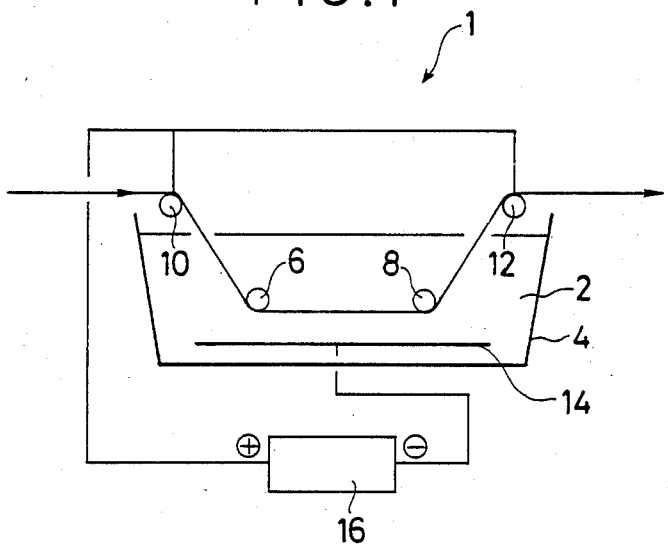
FIG. 1 is a schematic view of a typical apparatus for practicing the process of the invention for surface treatment by electrolytic oxidation.

In accordance with the invention, electricity in the form of pulses is supplied at regular intervals of time to carbon fiber tows each consisting of a multiplicity of filaments, while they are passing through an electrolytic cell. Thus, the process of the invention involves alternate steps of $OH^-$ ions replenishment to the tow center (no electric supply) and electrolytic oxidation (electric supply). During each no-electric supply interval between pulses the $OH^-$ ions are diffused and supplied to the tow center, and then the current is applied for a predetermined time period to effect electrolytic oxidation. In this way an adequate amount of $OH^-$ ions is allowed to be present in the tow center, and therefore the oxidation reaction proceeds in the center too, leading to a uniform surface treatment of the tow. At the point the $OH^-$ ions inside the tow have been consumed, the electric supply is cut off and the $OH^-$ ions diffusion and replenishment is resumed. By repeating the cycle uninterruptedly it is possible to surface treat the carbon fiber uniformly and efficiently.

Although there is no special limitation to the pulse spacing, usually an electric supply duration of 0.02 to 20 seconds and a no-electric supply duration of 0.02 to 20 seconds are desirable. Supply and no-supply durations of 0.1 to 5 seconds each are more desirable. A too short supply duration will not make thorough oxidation possible, while a too long duration will cause excessive oxidation which, in turn, decreases the strength of the product. The no-supply duration theoretically has no upper limit but, in industrial operation, approximately 20 seconds is the maximum.

The pulse shape has no special limitation, either. Usually, rectangular, triangular, or sine waves are used. The method of electric supply, type of electrolyte, and electrolytic conditions to be used under the invention may all be those well-known in the art. For example, the supply of electricity to the tows usually is accomplished through rolls or mercury electrodes as taught in British Patent No. 1,326,736. In order to reduce the damage of the tows, a non-contact method eliminating the use of rolls as disclosed in Japanese Patent Application Publication No. 29942/1972 or U.S. Pat. No. 4,234,398 may be employed instead. In the latter method, however, the resistance of thin liquid film necessitates the use of a higher voltage to provide the proper current density.

The electrolyte to be used may be an aqueous oxidizing agent or a strongly acidic solution such as of hypochlorite, concentrated sulfuric acid, concentrated sulfuric acid plus $Cr^{6+}$ ion, or permanganate; a strongly basic solution such as of sodium hydroxide; aqueous solution of a neutral salt such as sulfate or nitrate; aqueous weakly acidic solution as of a carboxylate or phosphate; or aqueous weakly basic solution as of sodium carbonate. Generally, the aqueous neutral salt is desirable because of its moderate corrosive action and ability to minimize the decrease in strength of the tows themselves. In the practice of the invention, an aqueous solution of sodium sulfate or sodium nitrate available as a common electrolyte may be used. Besides, the above-mentioned aqueous solution of sodium carbonate or sodium hydroxide may be employed as well.

Among the electrolytic conditions, applied voltage and current density are of particular importance. Under the invention, the two are suitably chosen from the ranges of 3 to 15 V and 0.2 to 1000 $A/m^2$, respectively. Current density is a vital factor in the electrolytic oxidation treatment, and the higher the density the shorter will be the treating time with the penalty of greater loss of Joule heat. In the practice of the invention, the current density may be chosen according to the degree of surface treatment required, from the range of 0.2 to 1000 $A/m^2$, preferably from the range of 1 to 100 $A/m^2$, more preferably from the range of 5 to 20 $A/m^2$.

Referring now to FIG. 1, there is shown a typical apparatus for practicing the process of the invention for surface treatment. The surface treatment apparatus, designated generally at 1, includes an electrolytic cell 4 holding an electrolyte 2. Inside the cell 4 are rotatably disposed a pair of lower rolls 6 and 8 spaced apart a predetermined distance with their axes in parallel. Above and near one end of the electrolytic cell 4, or in a location not immersible in the electrolyte, an inlet anode roll 10 is held rotatably. In a mirror-image location an outlet anode roll 12 is also held rotatably.

In the arrangement shown, each tow of carbon fiber is supplied from a reel (not shown) and forced along the inlet anode roll 10 into the electrolyte 2 as it is further led around the pair of lower rolls 6 and 8. The tow is then conducted out of the electrolytic cell via the outlet anode roll 12 and then washed with water and dried. Finally the tow is taken up on a reel (not shown). Inside the electrolytic cell, a cathode plate 14 is kept immersed in a location to face the carbon fiber tow stretched between and passing along the two lower rolls 6 and 8. To the cathode plate 14 and the inlet and outlet anode rolls 10, 12 are connected, respectively, the negative (−) and positive (+) terminals of a pulse source generator 16.

To be more concrete, the inlet and outlet anode rolls 10 and 12 may, for example, be rolls of graphite having a 40 mm diameter. The lower rolls 6 and 8 may be 40 mm-dia. rolls made of Teflon. The lower rolls 6 and 8 are spaced apart a distance of 800 mm and kept a distance of at least 140 mm away from both the inlet and outlet anode rolls 10 and 12. The cathode plate 14 is held in parallel with, at a distance of about 50 mm from, the carbon fiber tow passing through from one lower roll 6 to the other 8. The cathode plate 14 is usually formed of a stainless steel plate.

For the apparatus of the construction described, the output pulse voltage of the pulse source generator ranges from 5 to 10 V, and the speed at which the carbon fiber tow is passed through the cell ranges from 0.5 to 2.0 m/min.

The invention is illustrated by the following examples.

EXAMPLE 1

Carbon fiber tows were surface treated by the use of the electrolytic oxidation apparatus shown in FIG. 1. The carbon fiber used in experiments was of PAN type having a filament diameter of 7 μm. In the untreated state the filaments had a tensile strength of 323 $kg/mm^2$, modulus of elasticity of 23.1 $ton/mm^2$, and ILSS of 5.2 $kg/mm^2$. The electrolysis conditions used were: applied voltage=5 V; filament speed=1 m/min; electrolyte=aqueous solution of 5 wt % NaOH (temp. 25° C.); and pulse shape=rectangular.

In this example, tows of four different numbers of filaments, i.e., 3,000, 6,000, 12,000, and 24,000, were used, and pulsed electric supply was effected by alternately repeating current supply and no supply at intervals of 10 seconds each. The tensile strengths of the carbon fiber tows thus treated by electrolytic oxidation are given in Table 1.

Test pieces of carbon fiber-reinforced composite materials for ILSS measurements were made of the surface treated carbon fiber tows, and the ILSS measurements were taken by the short beam method. The results are also shown in Table 1.

The method of making the test pieces of carbon fiber-reinforced composite materials is briefly explained below.

The matrix was prepared by mixing 100 parts by weight of an epoxy resin (a product of Dainippon Ink & Chemicals, Inc., marketed under the trade designation "Epichlon 850"), 84 parts by weight of a curing agent (Hitachi Chemical Co.'s "HN-5500"), and 1 part by weight of a curing accelerator (Shikoku Chemicals Corp.'s ethylmethyl imidazole).

The bundle of carbon fiber tows impregnated with so prepared matrix resin was set in a mold and then cured under pressure in a hot press. During such process a certain volume of resin was flowed out of the mold such that the carbon fiber accounted for 60% of total volume. Each test piece of the carbon fiber-reinforced composite material had a length of 14 mm in the direction of the fiber axis and had a rectangular cross section measuring 6 mm by 2 mm.

TABLE 1

| No. of filaments in tow | Elec. supply duratn (sec) | No-supply duratn (sec) | Residence time in electlyte (sec) | Current (A) | Cur. dens. (A/m²) | Tens. str. (kg/mm²) | ILSS (kg/mm²) |
|---|---|---|---|---|---|---|---|
| | | | | Example 1 | | | |
| (1) 3,000 | 1.0 | 1.0 | 60 | 0.55 | 8.3 | 319 | 8.3 |
| (2) 6,000 | 1.0 | 1.0 | 60 | 1.10 | 8.3 | 325 | 8.3 |
| (3) 12,000 | 1.0 | 1.0 | 60 | 2.20 | 8.3 | 318 | 8.5 |
| (4) 24,000 | 1.0 | 1.0 | 60 | 4.40 | 8.3 | 322 | 8.1 |
| | | | | Comparative Example 1 | | | |
| (1) 3,000 | Cont. | — | 60 | 1.10 | 16.7 | 320 | 8.4 |
| (2) 6,000 | " | — | 60 | 2.20 | 16.7 | 309 | 8.0 |
| (3) 12,000 | " | — | 60 | 4.40 | 16.7 | 294 | 7.8 |
| (4) 24,000 | " | — | 60 | 8.80 | 16.7 | 235 | 7.4 |

COMPARATIVE EXAMPLE 1

The carbon fiber tows used in Example 1 were surface treated using the same apparatus and the same electrolysis conditions as in Example 1 with the exception that the electric supply to the tows was continuous instead of being pulsed.

Test pieces were made of the carbon fiber tows thus surface treated, in the same manner as described in Example 1. Their ILSS values were measured by the short beam method. The results are also given in Table 1.

It can be seen from the table that, in accordance with the present invention, carbon fiber-reinforced composite materials are obtained which do not show decreases in the ILSS values despite increases in the number of filaments per tow.

EXAMPLE 2

The procedure of Example 1 for surface treatment was repeated excepting that the carbon fiber tows used were of a pitch-derived carbon fiber (filament diameter=10 μm; tensile strength=273 kg/mm²; modulus of elasticity=32.5 ton/mm²; and ILSS=3.5 kg/mm²). Then, composite material test pieces were made and their ILSS values measured. Table 2 shows the results.

TABLE 2

| No. of filaments in tow | Elec. supply duratn (sec) | No-supply duratn (sec) | Residence time in electlyte (sec) | Current (A) | Cur. dens. (A/m²) | Tens. str. (kg/mm²) | ILSS (kg/mm²) |
|---|---|---|---|---|---|---|---|
| | | | | Example 2 | | | |
| (1) 3,000 | 1.0 | 1.0 | 60 | 0.79 | 8.3 | 275 | 7.6 |
| (2) 6,000 | 1.0 | 1.0 | 60 | 1.57 | 8.3 | 268 | 7.8 |
| (3) 12,000 | 1.0 | 1.0 | 60 | 3.14 | 8.3 | 266 | 7.4 |
| (4) 24,000 | 1.0 | 1.0 | 60 | 6.28 | 8.3 | 274 | 7.8 |
| | | | | Comparative Example 2 | | | |
| (1) 3,000 | Cont. | — | 60 | 1.57 | 16.7 | 269 | 7.3 |
| (2) 6,000 | " | — | 60 | 3.14 | 16.7 | 241 | 7.0 |
| (3) 12,000 | " | — | 60 | 6.28 | 16.7 | 198 | 6.5 |
| (4) 24,000 | " | — | 60 | 12.57 | 16.7 | 161 | 5.2 |
| | | | | Example 3 | | | |
| (1) 3,000 | 1.0 | 1.0 | 60 | 0.79 | 8.3 | 271 | 7.9 |
| (2) 6,000 | 1.0 | 1.0 | 60 | 1.57 | 8.3 | 275 | 7.6 |
| (3) 12,000 | 1.0 | 1.0 | 60 | 3.14 | 8.3 | 269 | 7.7 |
| (4) 24,000 | 1.0 | 1.0 | 60 | 6.28 | 8.3 | 273 | 7.8 |

COMPARATIVE EXAMPLE 2

The carbon fiber tows used in Example 2 were surface treated using the same apparatus and the same electrolysis conditions as in Example 1 with the exception that the electric supply to the tows was continuous instead of being pulsed.

Test pieces were made of the carbon fiber tows thus surface treated, in the same manner as described in Example 1. Their ILSS values were measured by the short beam method. The results are also given in Table 2.

It can be seen from the table that, in accordance with the present invention, carbon fiber-reinforced composite materials are obtained which do not show appreciable decreases in the ILSS values despite increases in the number of filaments per tow.

EXAMPLE 3

The procedure of Example 2 for the surface treatment of carbon fiber tows was repeated excepting that the pulsed power supply was in the form of sine waves. Then, composite material test pieces were made and their ILSS values measured in the same way as in Example 1. Table 2 shows the results.

It is obvious from Table 2 that the present invention gives favorable results irrespective of the wave form of the pulses employed.

EXAMPLE 4

Surface treatments were carried out in the same way as in Example 1 with the exception that the carbon fiber employed was of the rayon type (filament diameter=7 μm; tensile strength=318 kg/mm$^2$; modulus of elasticity=20.8 ton/mm$^2$; and ILSS=5.3 kg/mm$^2$). Then, composite material test pieces were made and their ILSS values measured. The results are given in Table 3.

TABLE 3

| No. of filaments in tow | Elec. supply duratn (sec) | No-supply duratn (sec) | Residence time in electlyte (sec) | Current (A) | Cur. dens. (A/m$^2$) | Tens. str. (kg/mm$^2$) | ILSS (kg/mm$^2$) |
|---|---|---|---|---|---|---|---|
| | | | | Example 4 | | | |
| (1) 3,000 | 1.0 | 1.0 | 60 | 0.55 | 8.3 | 322 | 8.7 |
| (2) 6,000 | 1.0 | 1.0 | 60 | 1.10 | 8.3 | 315 | 8.4 |
| (3) 12,000 | 1.0 | 1.0 | 60 | 2.20 | 8.3 | 313 | 8.5 |
| (4) 24,000 | 1.0 | 1.0 | 60 | 4.40 | 8.3 | 321 | 8.4 |
| | | | | Comparative Example 3 | | | |
| (1) 3,000 | Cont. | — | 60 | 1.10 | 16.7 | 318 | 8.6 |
| (2) 6,000 | " | — | 60 | 2.20 | 16.7 | 305 | 8.0 |
| (3) 12,000 | " | — | 60 | 4.40 | 16.7 | 287 | 7.6 |
| (4) 24,000 | " | — | 60 | 8.80 | 16.7 | 224 | 7.1 |

COMPARATIVE EXAMPLE 3

The carbon fiber tows used in Example 4 were surface treated using the same apparatus and the same electrolysis conditions as in Example 1 with the exception that the electric supply to the tows was continuous instead of being pulsed.

Test pieces were made of the carbon fiber tows thus surface treated, in the same manner as described in Example 1. Their ILSS values were measured by the short beam method. The results are also given in Table 3.

It can be seen from the table that, in accordance with the present invention, carbon fiber-reinforced composite materials are obtained which do not show appreciable decreases in the ILSS values despite increases in the number of filaments per tow.

EXAMPLE 5

Surface treatments were performed in the same way as in Example 1 with the exception that the carbon fiber employed was of the high-strength PAN type (filament diameter=8 μm; tensile strength=285 kg/mm$^2$; modulus of elasticity=39.4 ton/mm$^2$; and ILSS=3.4 kg/mm$^2$). Composite material test pieces were made and their ILSS values measured. Table 4 gives the results.

COMPARATIVE EXAMPLE 4

The carbon fiber tows used in Example 5 were surface treated using the same apparatus and the electrolysis conditions as in Example 1 with the exception that the electric supply to the tows was not pulsed but continuous.

Test piece were made of the carbon fiber tows thus surface treated, in the same manner as described in Example 1. Their ILSS values were measured by the short beam method. The results are also given in Table 4.

It can be seen from the table that, in accordance with the present invention, carbon fiber-reinforced composite materials are obtained which do not show appreciable decreases in the ILSS values despite increases in the number of filaments per tow.

TABLE 4

| No. of filaments in tow | Elec. supply duratn (sec) | No-supply duratn (sec) | Residence time in electlyte (sec) | Current (A) | Cur. dens. (A/m$^2$) | Tens. str. (kg/mm$^2$) | ILSS (kg/mm$^2$) |
|---|---|---|---|---|---|---|---|
| | | | | Example 5 | | | |
| (1) 3,000 | 1.0 | 1.0 | 60 | 0.63 | 8.3 | 283 | 8.0 |
| (2) 6,000 | 1.0 | 1.0 | 60 | 1.26 | 8.3 | 291 | 7.9 |
| (3) 12,000 | 1.0 | 1.0 | 60 | 2.51 | 8.3 | 279 | 8.2 |
| (4) 24,000 | 1.0 | 1.0 | 60 | 5.03 | 8.3 | 286 | 7.8 |
| | | | | Comparative Example 4 | | | |
| (1) 3,000 | Cont. | — | 60 | 1.26 | 16.7 | 281 | 8.1 |
| (2) 6,000 | " | — | 60 | 2.51 | 16.7 | 269 | 7.7 |
| (3) 12,000 | " | — | 60 | 5.03 | 16.7 | 242 | 7.5 |
| (4) 24,000 | " | — | 60 | 10.05 | 16.7 | 208 | 6.7 |

As has been described above, the present invention makes possible more uniform surface treatment of carbon fibers during the same residence time than by conventional processes. This is particularly true with the treatment of carbon fiber tows comprising large numbers of filaments. According to the invention, tows of 100,000 or more filaments can be uniformly treated. Moreover, the process is applicable to the treatment of not only PAN-, pitch, and rayon-type carbon fibers but also of the fibers made from other materials as the precursors.

Since a multiplicity of filaments can be simultaneously surface treated in accordance with the invention, the number of electrolytic treatment units can be substantially reduced as compared with conventional equipment. This permits simultaneous handling of a large number of filaments in the preceding stage of firing, too. Altogether, these features render it possible to greatly simplify the equipment for the manufacture of carbon fibers.

What is claimed is:

1. A process for the surface treatment of carbon fiber tows each consisting of a multiplicity of filaments, which comprises treating the tows by electrolytic oxidation, using each tow as a positive electrode and applying an electric current in the form of pulses.

2. A process according to claim 1 wherein the pulse spacing of the pulsed electric supply is set so that the electric supply and no-electric supply durations range from 0.02 to 20 seconds each.

3. A process according to claim 1 wherein the pulse spacing of the pulsed electric supply is set so that the electric supply and no-electric supply durations range from 0.1 to 5 seconds each.

4. A process according to claim 1 wherein the the pulses for electric supply takes the shape of rectangular, triangular, or sine waves.

5. A process according to claim 1 wherein the applied voltage for the pulsed electric supply ranges from 3 to 15 V, with the current density of from 0.2 to 1000 $A/m^2$.

6. A process according to claim 5 wherein the current density ranges form 1 to 100 $A/m^2$.

7. A process according to claim 5, wherein the current density ranges from 5 to 20 $A/m^2$.

8. A process according to any one of claims 1 through 7 wherein the electrolyte is an aqueous solution of an oxidizing agent or a strongly acidic solution of hypochlorite, concentrated sulfuric acid, concentrated sulfuric acid plus $Cr^{6+}$ ion, or permanganate; strongly basic solution as of sodium hydroxide; aqueous solution of a neutral salt of sulfate or nitrate; aqueous weakly acidic solution of a carboxylate or phosphate; or aqueous weakly basic solution of sodium carbonate.

9. A process according to any of claim 1 to 2 wherein the pulses for electric supply take the shape of rectangular, triangular or sine waves.

10. A process according to claim 9 wherein the electrolyte is an aqueous solution of an oxidizing agent of a strongly acidic solution of hydrochlorite, concentrated sulfuric acid, concentrated sulfuric acid plus $Cr^{6+}$ ion, or permanganate; strongly basic solution of sodium hydroxide; aqueous solution of a neutral salt as sulfate or nitrate; aqueous weakly acidic solution of a carboxylate or phosphate; or aqueous weakly basic solution of sodium carbonate.

* * * * *